US006122894A

United States Patent [19]

Romagnoli

[11] Patent Number: 6,122,894

[45] Date of Patent: Sep. 26, 2000

[54] APPARATUS FOR MAKING PRODUCT WRAPPERS FROM HEAT-SEALABLE PAPER

[75] Inventor: Andrea Romagnoli, San Lazzaro Di Savena, Italy

[73] Assignee: Tecnomeccanica S.r.l., Bologna, Italy

[21] Appl. No.: 09/271,703

[22] Filed: Mar. 18, 1999

[30] Foreign Application Priority Data

Mar. 27, 1998 [IT] Italy ..... BO98A0204

[51] Int. Cl.[7] ..... B65B 9/02; B65B 57/02

[52] U.S. Cl. ..... 53/51; 53/64; 53/550; 53/553; 53/371.4

[58] Field of Search ..... 53/51, 64, 550, 53/553, 371.4, 374.4

[56] References Cited

U.S. PATENT DOCUMENTS

| | | | |
|---|---|---|---|
| 2,871,639 | 2/1959 | Forgo . | |
| 3,140,572 | 7/1964 | Petersen et al. . | |
| 4,009,551 | 3/1977 | Greenawalt et al. | 53/51 |
| 4,566,253 | 1/1986 | Jones | 53/551 |
| 5,197,262 | 3/1993 | Katz et al. | 53/553 |

FOREIGN PATENT DOCUMENTS 083912 7/1983 European Pat. Off. .

*Primary Examiner*—John Sipos
*Attorney, Agent, or Firm*—Fay, Sharpe, Fagan, Minnich & McKee, LLP

[57] ABSTRACT

An apparatus for making a wrapper for a product comprises: a feed device; an area for unwinding a web of heat-sealable paper; a station for feeding products which continuously receives and feeds out a first web of paper while placing the products on the web in succession and spaced equally apart; a station for feeding a second web of heat-sealable paper, where the second web of paper, fed by the feed device, is laid over the products and moves along continuously together with the first web of paper below it; a sealing station where the two webs of paper are joined crossways and lengthways to form a chain of closed wrappers, each containing a product. The apparatus comprises a single pair of feed rollers equipped with sealing elements and means for automatically detecting and correcting the misalignment of the sealing elements relative to the webs of paper by causing the rollers and the webs of paper to slip relative to each other.

10 Claims, 5 Drawing Sheets

APPARATUS FOR MAKING PRODUCT WRAPPERS FROM HEAT-SEALABLE PAPER

BACKGROUND OF THE INVENTION

The present invention relates to automatic packaging apparatus and machinery for continuously making a chain of wrappers from heat-sealable paper, each wrapper containing a single product. The invention relates in particular to an apparatus for making individual wrappers for filter bags containing products to be infused such as tea, chamomile or other herb teas.

In state-of-the-art packaging technology, wrappers of this kind are made by apparatuses of numerous different kinds. One of these, used for packaging tea bags comprises: a feed device with a pair of motor-driven rollers whose lateral surfaces oppose each other; a station for unwinding a web of heat-sealable paper, from which a first web of paper, used to make the wrapper and having position references impressed on it, is continuously unwound by a feed device; a station for feeding filter bags which continuously receives and feeds out the first web of paper while placing the filter bags on the web in succession and spaced equally apart; a station for feeding a second web of heat-sealable paper, where the second web of paper, fed by the feed device, is laid over the filter bags and moves along continuously together with the first web of paper below it; a sealing station where the two webs of paper are joined crossways and lengthways to form a chain of closed wrappers, each containing a single filter bag.

This apparatus has two separate pairs of motor-driven rollers. The first pair, besides acting as a feed device, seals the webs of paper along their lengthways edges. The second pair of rollers, on the other hand, seals the webs crossways. The apparatus also has a system of opposing conveyor belts designed to place the individual filter bags on the first web in succession and spaced equally apart.

Although this kind of apparatus works correctly, it has the disadvantage of being mechanically very complex which makes it very expensive to construct. Another disadvantage is that this mechanical complexity adversely affects the efficiency of the system to detect and correct the misalignment of the seals using the position references impressed on the first web.

The aim of the present invention is to overcome the disadvantages mentioned above by providing an apparatus that is simple in construction and therefore economical to make.

SUMMARY OF THE INVENTION

In accordance with the invention, this aim is achieved by an apparatus according to the preamble to claim 1. The apparatus comprises a single pair of rollers which include first sealing elements to seal the two webs together at least crossways, these sealing elements acting in combination with means for automatically detecting their misalignment relative to the position references impressed on the first web and correcting the misalignment by slowing down the web in such a way as to create a controlled relative slipping action between the single pair of rollers and the first web.

The feed station also comprises a device for placing the products on the first web, the placing device in turn comprising a first and a second rotor which are operatively connected to each other. The first rotor turns about a fixed horizontal axis and is equipped with at least one radial pusher which, at each turn of the first rotor, intercepts the back of each product fed in individually and accelerates it along a product feed line downstream of the first rotor. The second rotor also turns about a fixed horizontal axis and is equipped with at least one stop which, at each turn of the second rotor, intercepts the product feed line. The second rotor is positioned above the first web and, when the feed line is in the intercepted condition, turns in such a way as to cause said stop or stops to turn at a peripheral speed identical to the feed speed of the first web, thus allowing the stop or stops to intercept the products accelerated by the first rotor and to place them on the first web in succession and spaced equally apart.

The apparatus made in accordance with the invention is much simpler, and hence much more economical to construct, than apparatus used for the same purpose up to the present time.

BRIEF DESCRIPTION OF THE DRAWINGS

The technical characteristics of the invention according to the above mentioned aims are described in the claims below and the advantages of the invention will become more apparent from the detailed description which follows, with reference to the accompanying drawings, which illustrate a preferred embodiment of the invention and in which:

DESCRIPTION OF THE PREFERRED EMBODIMENTS

Figure 1:
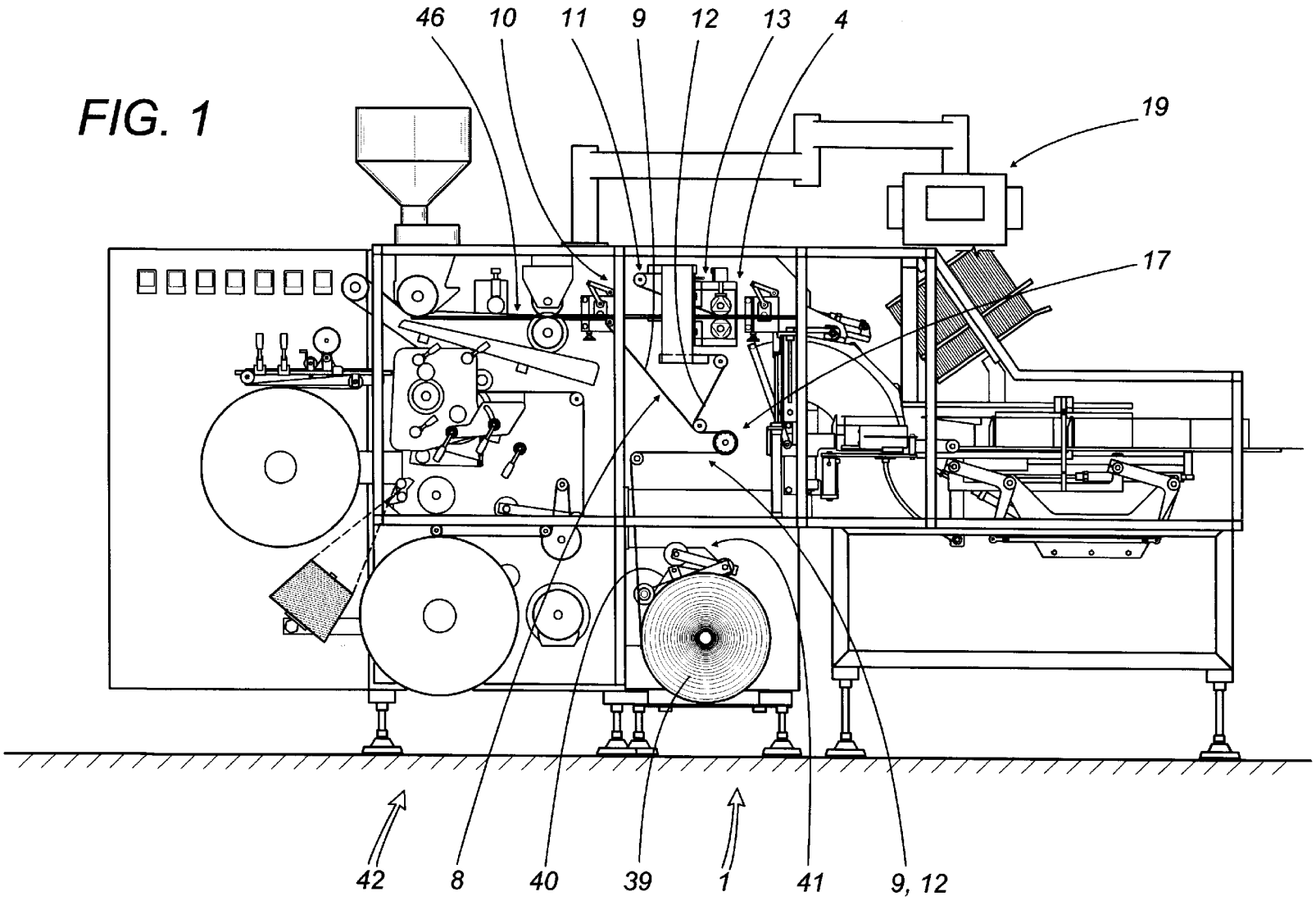
FIG. 1 is an assembly view of a product packaging machine equipped with the apparatus made in accordance with the present invention.

With reference to the accompanying drawings, the numeral 1 indicates as a whole an apparatus designed to make a wrapper 2 for a product 3 from heat-sealable paper. In this particular embodiment, the product is a filter bag, which in turn contains a product to be infused, such as tea, chamomile or other herb tea.

The apparatus 1, which is installed in a known filter bag making machine forming the subject-matter of an earlier patent application made by the present Applicant, basically comprises the following: a device 4 which feeds webs 9, 12 of heat-sealable paper; an area 8 for unwinding a first web 9 of heat-sealable paper; a station 10 for feeding products 3; a station 11 for feeding a second web 12 of heat-sealable paper; and a sealing station 13 where the two webs 9, 12 of heat-sealable paper are joined together.

Looking in more detail, the feed device 4 (FIGS. 1–2A) comprises a pair of motor-driven rollers 5, 6 whose lateral surfaces 7 oppose each other and which unwind a web of paper 40 from a single reel 39. After coming off the reel 39, the web 40 meets a cutting device 41 which cuts it lengthways to form the above mentioned first and second webs 9, 12 placed side by side. The two webs, after initially moving along the same path, first diverge along two separate paths defined by a series of transfer means (rollers 43 and diverters 44) around which the webs are wound and then converge on the same path again to cross the feed device 4, as described in more detail below.

The first web 9 of heat-sealable paper is unwound in the area 8 which, relative to the direction in which the paper is unwound from the reel 39, is downstream of the area where the two webs of paper 9, 12 diverge. Said unwinding area 8 comprises a sensor 16 that reads the first web 9 to measure the spacing between conventional position references impressed on the first web 9. The spacing is measured while the first web 9 is fed continuously through the unwinding area 8 by the pulling action applied by the feed device 4.

The station 10 that feeds the products 3 (filter bags) is located near an end area 45 where the first web 9, as it leaves the unwinding area 8, is diverted so that it feeds continuously in a direction that is substantially the continuation of a line 46 which forms and feeds out an endless tubular wrapping consisting of a succession of filter bags attached to one another. The forming line 46 is located upstream of the apparatus 1 and does not form part of the present invention.

Figure 5:
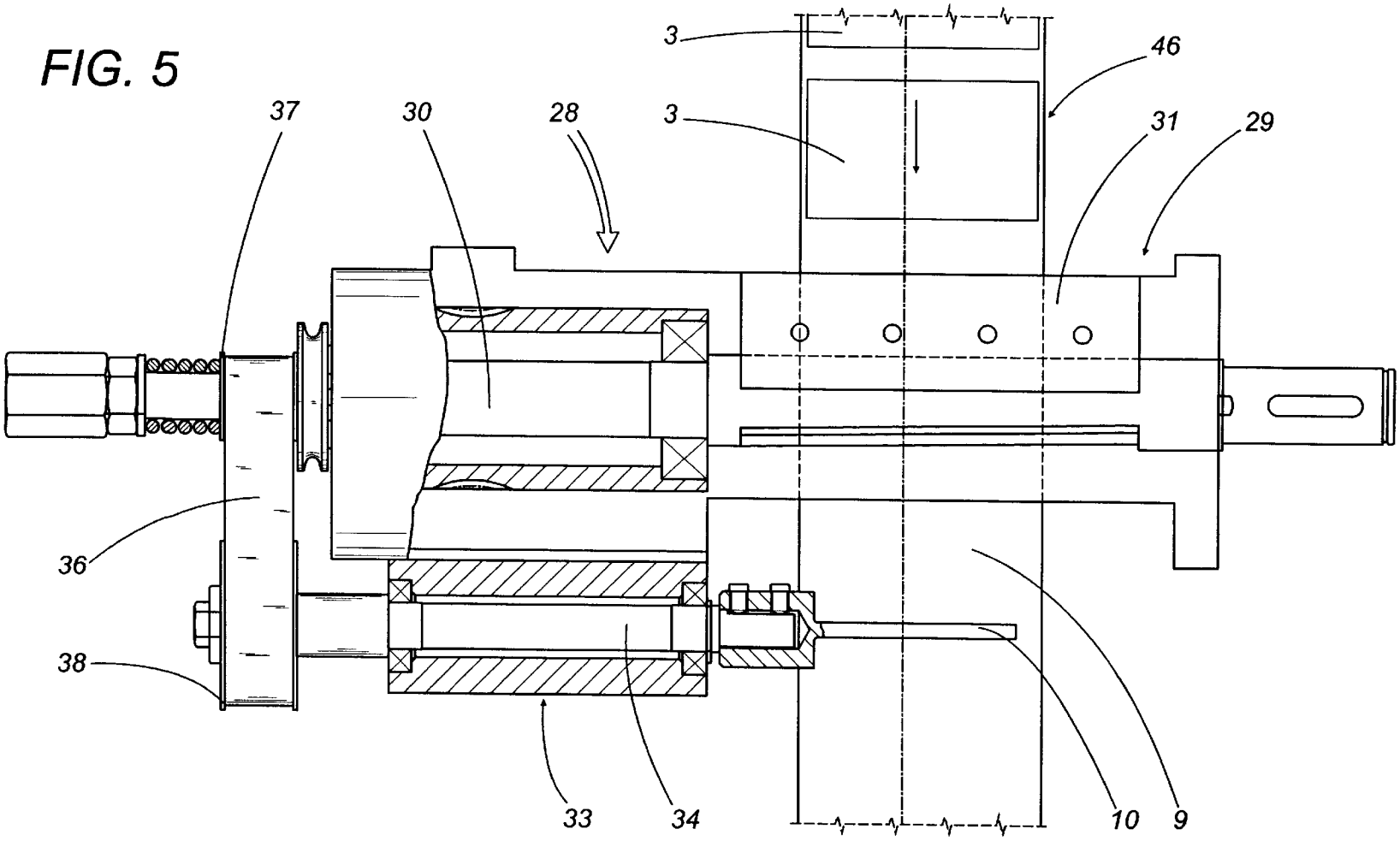
FIGS. 5 and 6 show a top plan view and an elevation view of another detail of the apparatus made in accordance with the present invention.
Figure 6:
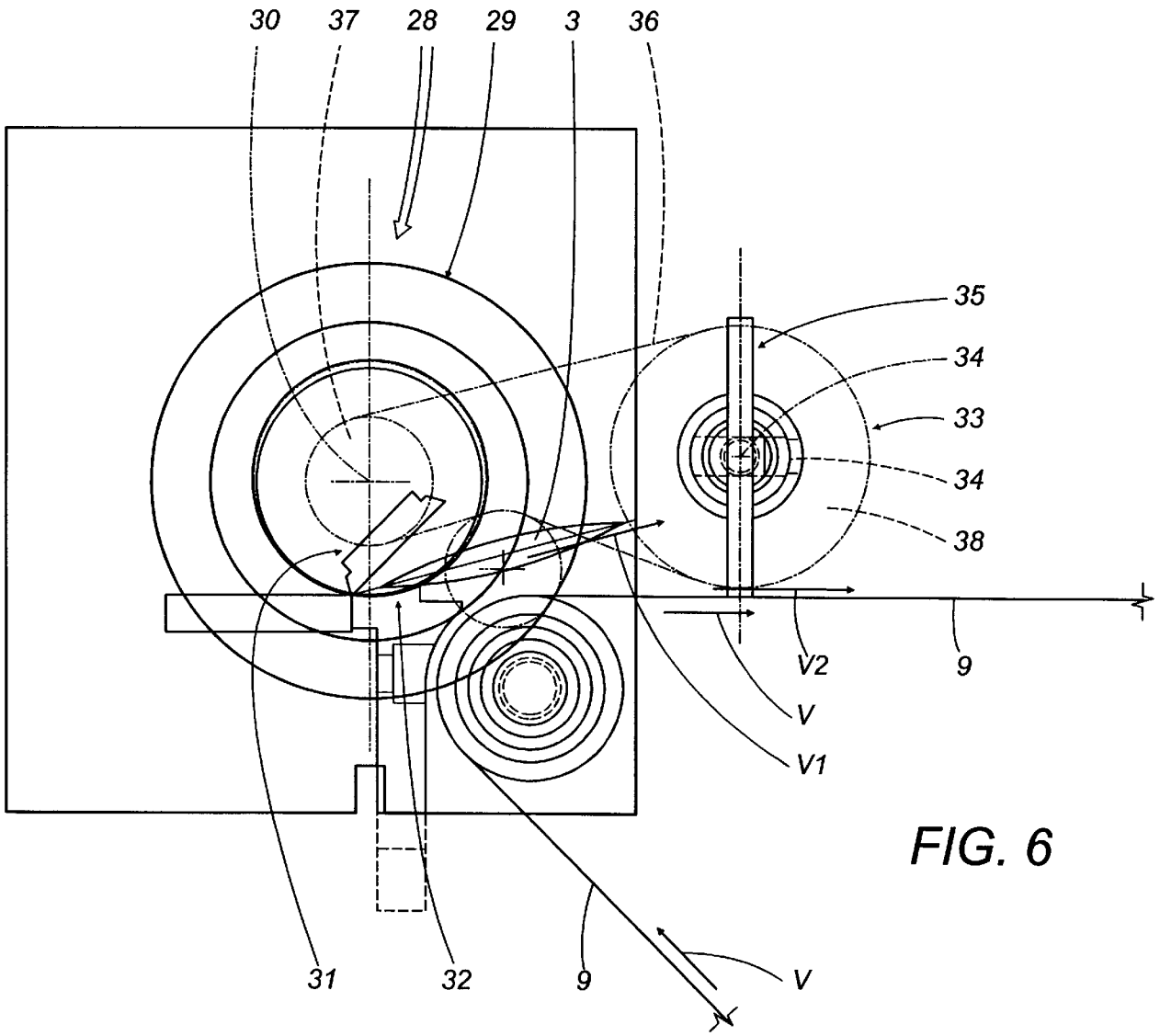

The feed station 10 includes a device 28 that places the products on the first web 9. The placer 28 is equipped with two rotors 29, 33 (FIGS. 5 and 6) driven in synchrony by a motor through a transmission unit which comprises a flexible element 36 looped around a pair of pulleys 37, 38 and connecting said rotors 29, 33.

The first rotor 29 turns about a fixed, horizontal axis of rotation 30 and is equipped with a radial pusher 31. The pusher consists of a knife 31 which, each time the first rotor 29 turns, cuts the products 3 from the endless tubular wrapping fed to it by the station 10 so as to physically separate them from the endless tube. After cutting off the products 3, the pusher 31 intercepts the back of each, pushing it and accelerating it along a product feed line 32, downstream of the forming line 46 at a speed V1 that is faster than the speed V at which the first paper web 9 below is moving.

The second rotor 33 is mounted at a level higher than the first web 9, above the horizontal section of the web 9, which is aligned with the forming line 46. It also turns about a fixed, horizontal axis of rotation 34, parallel to the axis 30, and is equipped with a flat stop 35 that also turns about the axis 34.

Each time the second rotor 33 turns, the stop 35 periodically intercepts the product 3 which is moving at the accelerated speed along its feed line 32. Under these conditions, the stop 35, which is turning at a peripheral speed V2 that is less than the speed V at which the first web 9 is being fed, slows down the products 3 and places them on the first web 9 in succession and spaced equally apart from one another.

The station 11 that feeds the second web of heat-sealable paper 12 is located between the product 3 feed station 10 and the feed device 4 and is designed to lay the second web of heat-sealable paper 12, also fed by the feed device 4, over the filter bags 3 as they move continuously, supported by the first web 9, towards the feed device 4.

Figures 2A, 2B:
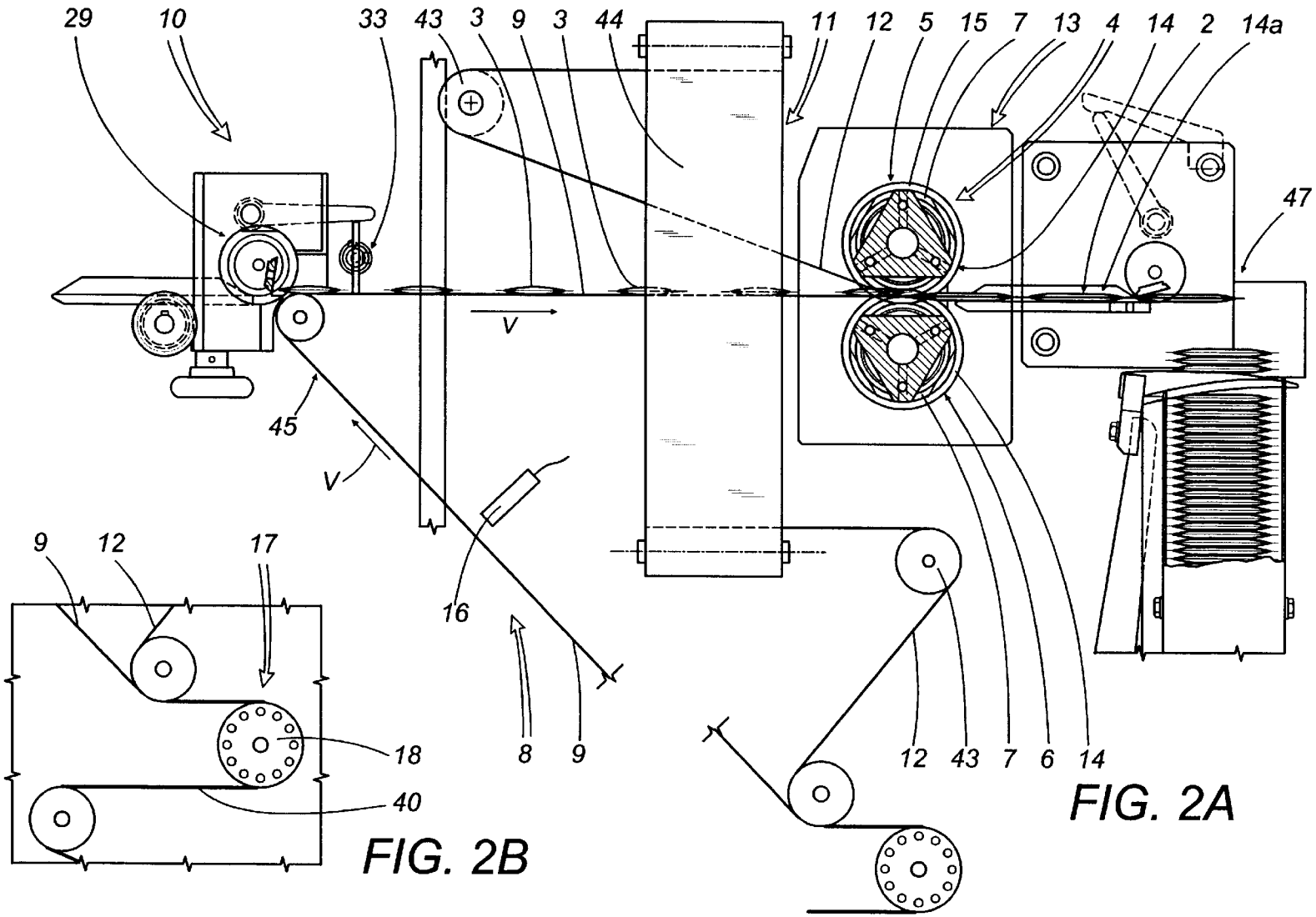
FIGS. 2A and 2B are scaled-up views of the apparatus made in accordance with the present invention, with some parts cut away in order to better illustrate others.

As shown in FIGS. 1 and 2A, the sealing station 13 is built into the feed device 4. In fact, first sealing elements 14 are mounted along the rollers 5, 6 lengthways in order to seal the two webs of paper 9, 12 to each other crossways, and second sealing elements 15 are distributed around the circumference of the rollers 5, 6 in order to seal the two webs of paper 9, 12 to each other lengthways.

As they move through the station 13, the two webs 9, 12 of heat-sealable paper are therefore joined to each other crossways and lengthways so as to form a continuous chain of closed wrappers 14*a*, each containing a single filter bag 3. A conventional cutter 47 then separates the wrappers 14*a* from one another and stacks them.

The apparatus 1 is equipped with control means for automatically detecting and correcting the misalignment of the sealing elements 14 relative to the first paper web 9. In addition to the above mentioned sensor 16, said control means comprise a braking device connected to the first and second paper webs 9, 12 and located between the unwinding area 8 and the reel 39.

Figure 3:
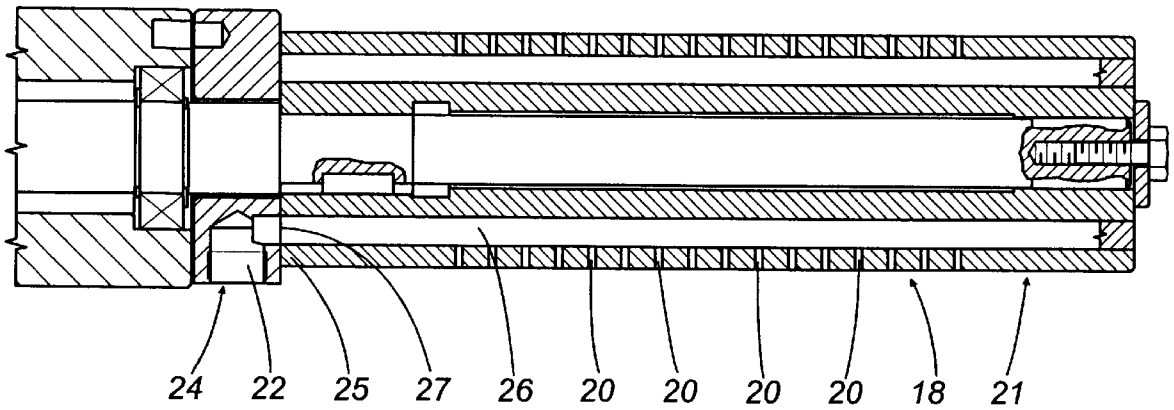
FIG. 3 is a cross section of a detail of the apparatus.

The braking device 17 comprises a special unwinding roller 18 (FIGS. 2B and 3) which, relative to the unwinding direction of the paper from the reel 39, is located upstream of the branch where the feed paths of the first and second paper webs 9, 12 diverge.

The unwinding roller is made in such a way as to cause the first and second paper webs 9, 12 to travel at a speed that is less than the speed at which they are made to travel by the rollers 5, 6 of the feed device 4. That is because the diameter of the unwinding roller 18 is smaller than the diameter of the rollers 5, 6 of the feed device 4.

The unwinding roller 18 also has means, controlled by the main control means 19 of the apparatus 1, for making the paper adhere to the unwinding roller 18. When the adhering means are switched on, the first and second paper webs 9, 12 are made to travel at a speed that is equal to the peripheral speed of the unwinding roller 18, which in turn causes the first and second paper webs 9, 12 to slip on the surfaces of the rollers 5, 6 of the feed device 4. When the adhering means are switched off, the first and second paper webs 9, 12 are allowed to travel at the same speed as the peripheral speed of the rollers 5, 6 of the feed device 4 and consequently the two paper webs 9, 12 slip on the surface of the unwinding roller 18.

The adhering means consist of a plurality of holes 20 which run radially through the lateral surface 21 of the unwinding roller 18, and a suction chamber 22 made in the unwinding roller 18.

Figure 4A:
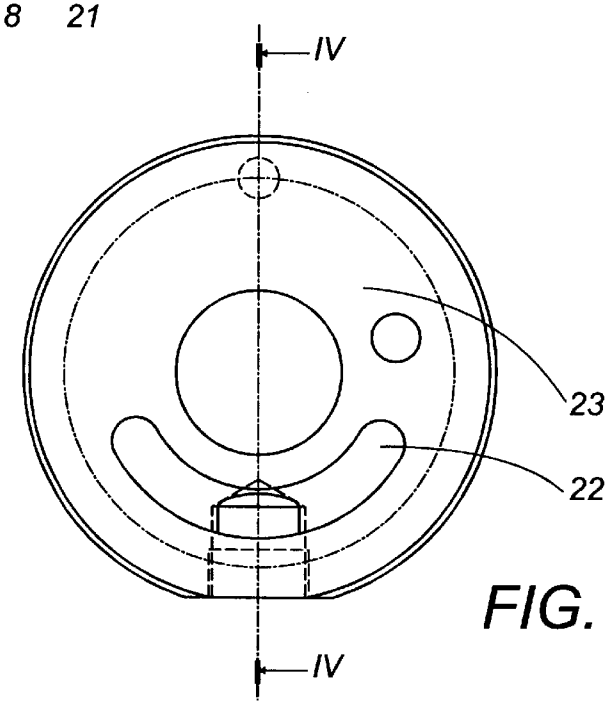
FIGS. 4A and 4B show a detail from FIG. 3 in cross section and in a plan view.
Figure 4B:
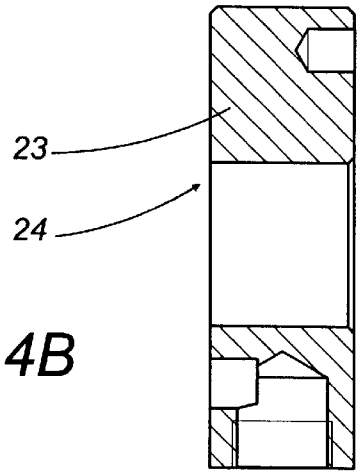

The suction chamber 22 (FIGS. 4A and 4B) is made in a flat face 23 of a manifold 24 to which a flat base surface 25 of the unwinding roller 18 is coupled. The unwinding roller 18 has ducts 26 in it which enable the holes 20 in its lateral surface 21 to communicate with holes 27 made in the base surface and therefore, as the unwinding roller 18 turns, the holes 27 in the base surface come cyclically in line with the chamber 22 so as to connect the chamber with the holes 20 in the lateral surface of the unwinding roller 18.

As a result, during the rotation of the unwinding roller 18, the suction chamber 22, which is a slot having the shape of a circular arc, cyclically communicates with a certain number of holes 20 in the lateral surface 21. When the suction in the chamber 22 is switched on, the unwinding roller 18 can transmit feed motion to the two paper webs 9, 12 because the two webs 9, 12 adhere to its surface. When the vacuum is switched off, the feed motion of the two paper webs 9, 12 is transmitted solely by the rollers 5, 6.

During operation, the sensor 16 measures the spacing between the reference marks on the first web 9 and sends signals to the automatic control means to switch the braking device on and off as required. In this way, the speed of the paper webs 9, 12 is made to vary continuously between the maximum speed of the feed rollers 5, 6 and the minimum speed of the unwinding roller 18. In both situations, there is relative slipping between: the paper webs 9, 12; the rollers 5, 6 of the feed device 4; and the unwinding roller 18. This makes it possible to instantaneously correct the feed speed of the webs 9, 12 according to the preset spacing, compensating for any differences by allowing the paper to slip over one roller or the other alternately.

The invention described can be subject to modifications and variations without thereby departing from the scope of the inventive concept. Moreover, all the details of the invention may be substituted by technically equivalent elements.

What is claimed:

1. An apparatus for making a wrapper from heat-sealable paper for a product, comprising: a feed device with a pair of motor-driven rollers whose lateral surfaces oppose each other; an area for unwinding a web of heat-sealable paper, from which a first web of paper, used to make the wrapper and having position references impressed on it, is continuously unwound by the feed device; a station for feeding products which continuously receives and feeds out the first web of paper while placing the products on the web in succession and spaced equally apart; a station for feeding a second web of heat-sealable paper, where the second web of paper, fed by the feed device, is laid over the products and moves along continuously together with the first web of paper below it; a sealing station where the two webs of paper are joined crossways and lengthways to form a chain of closed wrappers, each containing a single product, the apparatus wherein said pair of rollers comprises first sealing elements to seal the two webs together at least crossways and wherein means are comprised for automatically detecting the misalignment of the sealing elements relative to the position references impressed on the first web and correcting the misalignment by causing a controlled relative slipping action between the rollers and the first web.

2. The apparatus according to claim 1, wherein there is a single pair of rollers and the rollers include second sealing elements to seal the two webs together lengthways.

3. The apparatus according to claim 1, comprising a sensor designed to measure the spacing between the reference marks on the first web, wherein the rollers are made in such a way that, in a given unit of time, they cause the first and second webs of paper to move forward by a feed step that is longer than the spacing between the reference marks on the first web, the automatic control means comprising a braking device acting at least on the first web of paper and located between the unwinding area and the sensor, said braking device causing a relative slipping action between the first web of paper and the rollers in such a way as to at least partially reduce the difference between the feed step and the spacing.

4. The apparatus according to claim 3, wherein the braking device comprises a roller which unwinds at least the first web from the unwinding area, said unwinding roller being made in such a way as to cause the first web to travel at a speed that is less than the speed at which it is made to travel by the rollers of the feed device, the unwinding roller being equipped with means, controlled by the main control means of the apparatus, for making the paper adhere to the unwinding roller so that, when the adhering means are switched on, the first paper web is made to travel at a speed that is equal to the peripheral speed of the unwinding roller, which in turn causes the first paper web to slip on the surfaces of the rollers of the feed device, and, when the adhering means are switched off, the first paper web travels at the same speed as the peripheral speed of the rollers of the feed device and the first paper web is therefore made to slip on the surface of the unwinding roller.

5. The apparatus according to claim 4, wherein the adhering means comprise a plurality of holes which run radially through the lateral surface of the unwinding roller, and a suction chamber made in the unwinding roller, said suction chamber being made in such a way that, as the unwinding roller turns, it cyclically communicates with a certain number of holes in the lateral surface and, when the suction is switched on, causes at least the first web to adhere and feed motion to be transmitted to the first web by the unwinding roller, whereas, when the suction is switched off, the web simply runs over the unwinding roller.

6. The apparatus according to claim 5, wherein the diameter of the unwinding roller is smaller than the diameter of the rollers of the feed device.

7. The apparatus according to claim 5, wherein the suction chamber is made in a flat face of a manifold to which a flat base surface of the unwinding roller is coupled, the unwinding roller having ducts in it which enable the holes in its lateral surface to communicate with holes made in the base surface and therefore, as the unwinding roller turns, the holes in the base surface come cyclically in line with the chamber so as to connect the latter with the holes in the lateral surface of the unwinding roller.

8. The apparatus according to claim 1, wherein the station which feeds the products comprises a device for placing the products on the first web, the placing device in turn comprising a first rotor that turns about a fixed horizontal axis of rotation and is equipped with at least one radial pusher which, at each turn of the first rotor, intercepts the back of each product and accelerates it along a product feed line downstream of the first rotor; and a second rotor that turns about a fixed horizontal axis of rotation and is equipped with at least one stop which, at each turn of the second rotor, intercepts the product feed line, said second rotor being positioned above the first web and, when the feed line is in the intercepted condition, turns in such a way as to cause said stop or stops to turn at a peripheral speed identical to the feed speed of the first web, thus allowing the stop or stops on the second rotor to intercept the products accelerated by the first rotor and to place them on the first web in succession and spaced equally apart.

9. The apparatus according to claim 8, wherein the pusher consists of a knife which, each time the first rotor turns, cuts a product from the endless chain of products fed in upstream of the knife.

10. The apparatus according to claim 8, wherein the first and second rotors are driven in synchrony by a motor through a transmission unit comprising a flexible element which is looped around a pair of pulleys and connects said rotors.

* * * * *